US011092295B2

(12) United States Patent
Yui

(10) Patent No.: US 11,092,295 B2
(45) Date of Patent: Aug. 17, 2021

(54) LENS WITH EXPANDED REFLECTING SURFACE

(71) Applicant: Koito Manufacturing Co., Ltd., Tokyo (JP)

(72) Inventor: Hiroyuki Yui, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 16/019,617

(22) Filed: Jun. 27, 2018

(65) Prior Publication Data

US 2019/0011094 A1 Jan. 10, 2019

(30) Foreign Application Priority Data

Jul. 6, 2017 (JP) ..... JP2017-132689

(51) Int. Cl.

| | |
|---|---|
| ***F21S 8/00*** | (2006.01) |
| ***F21S 41/25*** | (2018.01) |
| ***F21S 43/14*** | (2018.01) |
| ***F21S 43/31*** | (2018.01) |
| ***F21S 43/37*** | (2018.01) |

(52) U.S. Cl.

CPC ..... *F21S 8/00* (2013.01); *F21S 41/25* (2018.01); *F21S 43/14* (2018.01); *F21S 43/315* (2018.01); *F21S 43/37* (2018.01)

(58) Field of Classification Search

CPC ..... F21S 41/147; F21S 41/148; F21S 41/30; F21S 43/315

See application file for complete search history.

(56) References Cited

U.S. PATENT DOCUMENTS

| | | | | |
|---|---|---|---|---|
| 7,416,322 | B2 * | 8/2008 | Tanaka | F21S 41/321 362/514 |
| 9,822,947 | B2 * | 11/2017 | Owada | F21S 41/19 |
| 2005/0088758 | A1 * | 4/2005 | Minano | F21S 41/322 359/726 |
| 2005/0180158 | A1 * | 8/2005 | Komatsu | F21V 5/04 362/545 |
| 2006/0087860 | A1 * | 4/2006 | Ishida | F21S 43/247 362/517 |
| 2016/0053967 | A1 * | 2/2016 | Owada | F21V 7/0091 362/520 |
| 2017/0089541 | A1 * | 3/2017 | Nakajima | B60Q 1/22 |
| 2017/0219181 | A1 * | 8/2017 | Lisowski | B60Q 1/2665 |

FOREIGN PATENT DOCUMENTS

JP 2016-091825 A 5/2016

* cited by examiner

*Primary Examiner* — Matthew J. Peerce

(74) *Attorney, Agent, or Firm* — Abelman, Frayne & Schwab

(57) ABSTRACT

Disclosed is a lens including a lens body. The lens body including an incidence portion on which light from a light source is incident, a reflecting portion having a first reflecting surface configured to internally reflect the incident light, an emitting portion configured to emit the reflected light, and an attachment portion configured to attach the lens body to a lamp. A recessed portion configured to define a second reflecting surface continuous to the first reflecting surface is formed between the attachment portion and the reflecting portion.

11 Claims, 6 Drawing Sheets

ENLARGED VIEW OF PORTION B

CROSS SECTION ON LINE C-C

LENS WITH EXPANDED REFLECTING SURFACE

CROSS-REFERENCE TO RELATED APPLICATIONS

This application is based on and claims priority from Japanese Patent Application No. 2017-132689, filed on Jul. 6, 2017 with the Japan Patent Office, the disclosure of which is incorporated herein in its entirety by reference.

TECHNICAL FIELD

The present disclosure relates to a lens configured to internally reflect incident light from a light source from a reflecting surface of a lens body and emit the reflected light from an end surface of the lens body. Specifically, the present disclosure relates to a technique for expanding a reflecting surface.

BACKGROUND

In the related art, there is known an edge light that emits, from an end surface of a lens, light incident from a light source. For example, an edge light 50 illustrated in FIGS. 6A and 6B includes a plate-shaped lens 51 and a light source 52, and is configured to internally reflect light incident from the light source 52 from a reflecting surface 54 of a reflecting portion 53 provided in a lens body 55 and to emit the reflected light L forward from an end surface 56 of the lens body 55. According to this configuration, by forming the end surface 56, which is an emitting surface, to be elongated, there is an advantage in that it is possible to form a narrow light distribution pattern of emitted light may be formed, which is difficult to realize with a lamp in which a light source bulb and a reflector are combined or a lamp in which an LED light source and a spider lens are combined.

In Japanese Laid-open Patent Publication No. 2016-091825, a vehicle lamp is disclosed, in which light from a light source is made incident on a lens to be internally reflected by a plurality of reflecting surfaces and emitted from an end surface of the lens in a desired direction, thereby forming a narrow light distribution pattern of emitted light in front of the lamp.

SUMMARY

In the edge light 50 illustrated in FIGS. 6A and 6B, since the reflected light L passes through the inside of the lens body 55, it is necessary to provide the attachment portion 57 of the lens 51 with respect to the lamp to the lens body 55 on the rear side of the reflecting portion 53. However, according to this configuration, since the reflecting portion 53 and the attachment portion 57 are disposed so as to divide the thickness of the lens body 55 into two, as illustrated in FIG. 6A, when the thickness of the attachment portion 57 is increased in order to increase the attachment strength of the lens 51, the height of the reflecting portion 53 is lowered, the area of the reflecting surface 54 is reduced, and the luminous intensity of the edge light 50 is decreased. On the other hand, when the height of the reflecting portion 53 is increased and the reflecting surface 54 is expanded in order to enhance the light intensity of the edge light 50, the attachment portion 57 becomes thin and there is a problem that the attachment strength of the lens 51 is decreased.

Therefore, it is an object of the present disclosure to provide a lens in which a reflecting surface having a relatively large area and an attachment portion having a sufficient thickness are provided in a lens body having a limited thickness to increase both of the mounting strength of the lens and the luminous intensity of a lamp.

In order to solve the above problem, a lens according to the present disclosure includes a lens body that includes an incidence portion on which light from a light source is incident, a reflecting portion having a first reflecting surface configured to internally reflect the incident light, an emitting portion configured to emit the reflected light, and an attachment portion configured to attach the lens body to a lamp. A recessed portion configured to define a second reflecting surface continuous to the first reflecting surface is formed between the attachment portion and the reflecting portion.

In an exemplary embodiment of the present disclosure, a lens suitable for an edge light is provided. In this lens, an attachment portion is provided on a lens body on the side opposite to the emitting portion, the reflecting portion is provided on the lens body on the side opposite to the incidence portion, and the recessed portion is recessed toward the incidence portion between the attachment portion and the reflecting portion. However, the application of the lens is not limited to the edge light.

The lens body is not limited to a specific shape. The lens body is formed, for example, in a plate-shape or a block-shape depending on the application of the lens. The recessed portion configured to define a second reflecting surface may be formed to have a flat bottom surface in view of the fact that the strength of the attachment portion is able to be maintained. Further, the recessed portion may include a groove having a substantially V-shaped cross section.

In an exemplary embodiment of the present disclosure, a first reflecting surface includes a parabolic surface opened toward the emitting portion and the second reflecting surface includes a curved surface continuous to the parabolic surface so as to emit parallel light from the emitting portion. Further, the incidence portion may include a curved surface recessed in the lens body in order to efficiently distribute the incident light from a light source to the first and second reflecting surface.

According to the lens of the present disclosure, the reflecting portion forms the first reflecting surface and the recessed portion between the reflecting portion and the attachment portion defines the second reflecting surface to continue to the first reflecting surface. Therefore, it is possible to increase the mounting strength of the lens and the luminous intensity of a lamp by providing the reflecting surface having a relatively large area and the attachment portion having a sufficient thickness in the lens body having a limited thickness.

The foregoing summary is illustrative only and is not intended to be in any way limiting. In addition to the illustrative aspects, embodiments, and features described above, further aspects, embodiments, and features will become apparent by reference to the drawings and the following detailed description.

DESCRIPTION OF EMBODIMENT

In the following detailed description, reference is made to the accompanying drawing, which form a part hereof. The illustrative embodiments described in the detailed description, drawing, and claims are not meant to be limiting. Other embodiments may be utilized, and other changes may be made, without departing from the spirit or scope of the subject matter presented here.

Figure 1:
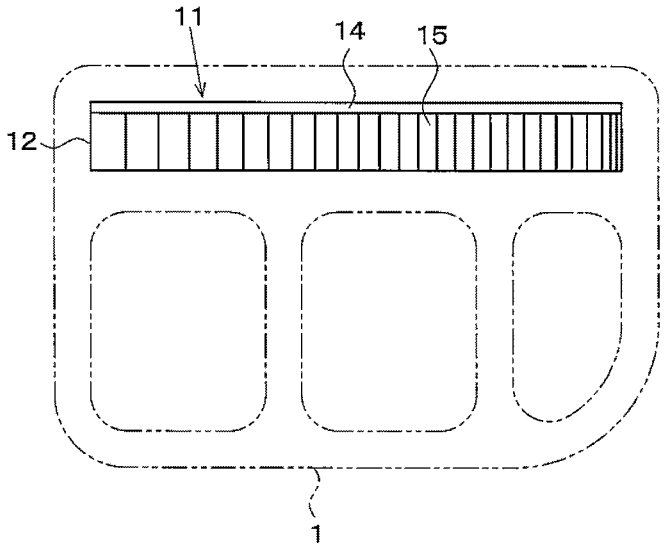
FIG. 1 is a front view of a vehicle edge light, illustrating an exemplary embodiment.

Hereinafter, an exemplary embodiment in which the present disclosure is implemented in a vehicle edge light will be described with reference to the drawings. An edge light 11 illustrated in FIG. 1 includes a lens 12 above a rear combination lamp 1 and a light source unit 13 below the lens 12. The lens 12 includes a lens body 14 made of a transparent resin, and an emitting portion 15 is provided on the front end surface (an end surface facing the rear side of the vehicle) on the lens body 14 to be elongated in a vehicle width direction. The light source unit 13 includes a substrate 16, and a plurality of LED light sources 17 are disposed on the substrate so as to face the lower surface of the lens body 14.

Figure 2:
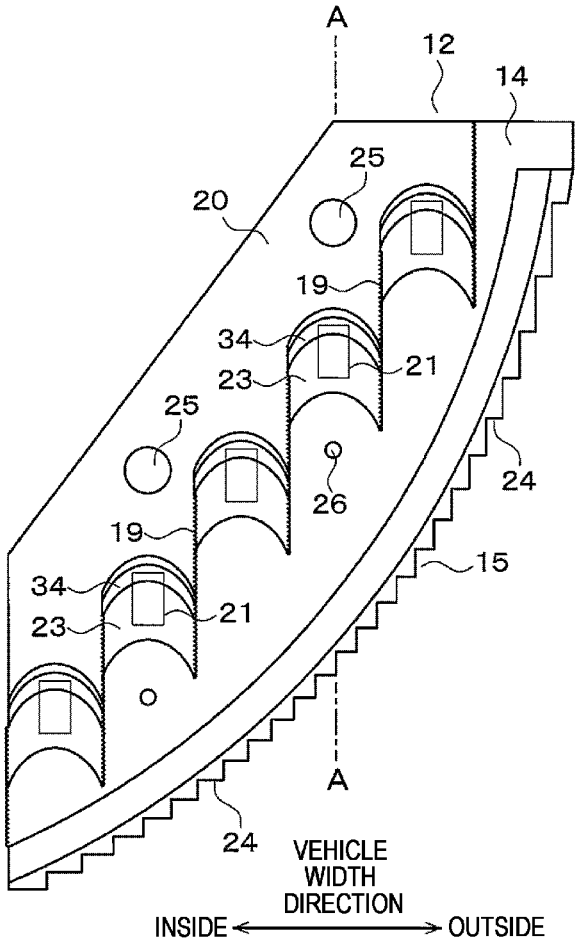
FIG. 2 is a plane view illustrating a lens of the edge light in FIG. 1.

As illustrated in FIG. 2, the lens body 14 is shaped in a plate-shape configured to be enlarged diagonally from the outside to the inside in the vehicle width direction, according to the shape of the vehicle body corner portion. An attachment portion 20 configured to attach the lens body 14 to a housing (not illustrated) of the rear combination lamp 1 is provided on the lens body 14 on the side opposite to the emitting portion 15. Incidence portions 21 on which light emitted from the LED light sources is incident are provided on the lower surface of the lens body 14. Further, reflecting portions 23, each including a first reflecting surface 22 (see, e.g., FIG. 3) configured to internally reflect the incident light, are provided on the upper surface of the lens body 14 on the side opposite to the incidence portion 21.

The reflecting portions 23 and the incidence portions 21, the number of each of which is the same as the number of the LED light sources 17, are arranged diagonally from the outside to inside in the vehicle width direction. In order to relieve influence of light interference between the reflecting portions 23 and the incidence portions 21, a light diffusing portion 19 is provided on the boundary between each adjacent reflecting portions 23. The light diffusing portions 19 are, for example, knurled surfaces. The emitting portion 15 and the attachment portion 20 are provided continuously in the vehicle width direction on the front side and the rear side of the reflecting portion 23, respectively. A plurality of light diffusion steps 24 configured to scatter the emitted light in the vehicle width direction are provided on the emitting portion 15. Attachment holes 25 are formed at appropriate portions of the attachment portion 20, and caulking pins 26 are protruded from the upper surface of the lens body 14 in front of the attachment holes 25.

Figure 3:
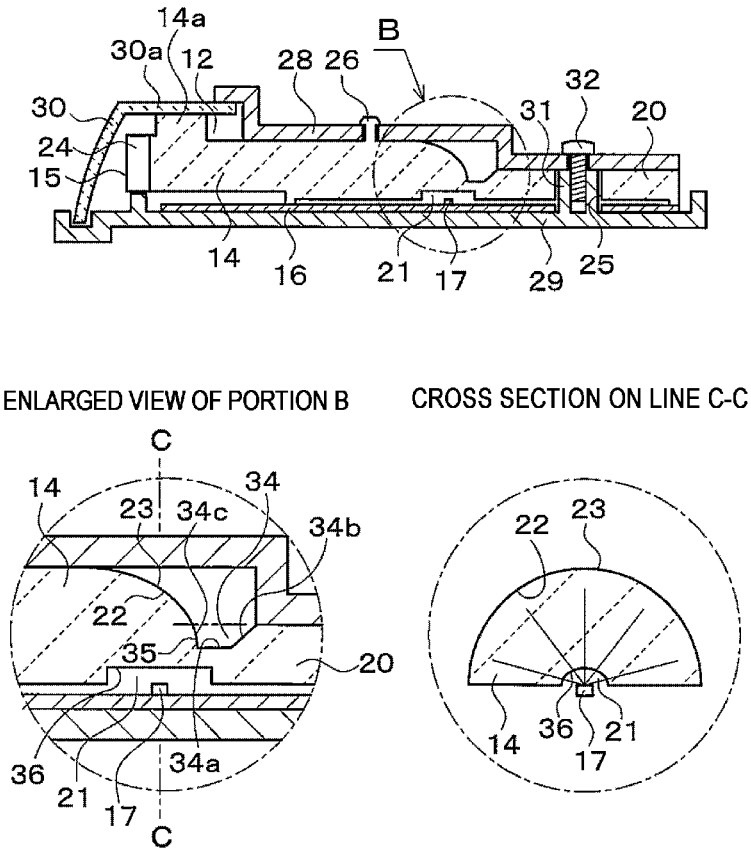
FIG. 3 is a cross-sectional view illustrating an attachment structure of the lens taken along the line A-A of FIG. 2.

As illustrated in FIG. 3, in the lamp housing, a pair of upper and lower brackets 28 and 29 configured to hold the lens body 14 and an inner lens 30 configured to cover the emitting portion 15 are provided inside the rear combination lamp 1. A boss portion 31 to be inserted into each attachment hole 25 of the lens body 14 is protruded from the lower bracket 29, and the attachment portion 20 of the lens body 14 is sandwiched between the brackets 28 and 29 by a screw 32 configured to be screwed into the boss portion 31. In front of the attachment portion 20, the lens body 14 is fixed to the upper bracket 28 by the caulking pins 26, and the inner lens 30 is sandwiched between the front ends of the upper and lower brackets 28 and 29.

The caulking pins 26 may be used, for example, to fix the inner lens 30 provided in front of the edge light 11. In the exemplary embodiment illustrated in FIG. 3, by fixing the upper bracket 28 to the lens body 14 with the caulking pins 26, a rearward extension portion 30*a* of the inner lens 30 may be hooked to the front end of the upper bracket 28, and a lower end of the inner lens 30 may be hooked to the front end of the lower bracket 29. Further, as another example, a caulking pin (not illustrated) is protruded from a front end protrusion 14*a* of the lens body 14, and, by inserting the caulking pin into a hole or an opening formed in the rearward extension portion 30*a* of the inner lens 30, the inner lens 30 may be fixed to the lens body 14. In any of the examples, since the edge light 11 is assembled to the lamp directly or indirectly, an assembly including the edge light 11 and the inner lens 30 may be easily assembled to the lamp.

As illustrated in an enlarged view of the portion B of the lens body 14 in FIG. 3, a recessed portion 34 is formed on the upper surface of the lens body 14 so as to be recessed toward the incidence portion 21 between the attachment portion 20 and the reflecting portion 23. The recessed portion 34 is defined such that the bottom surface 34*a* is flat, the rear side surface 34*b* of the attachment portion 20 side is an inclined surface, the front side surface 34*c* of the reflecting portion 23 side is defined that a second reflecting surface 35 (the portion lower than a virtual line illustrated in the enlarged view of B portion) continues to the lower side of the first reflecting surface 22 (the portion above the same virtual line). The first reflecting surface 22 includes a parabolic surface configured to be opened toward the emitting portion 15 and the second reflecting surface 35 is a curved surface included in the same parabolic surface, in order to be able to emit parallel light from the emitting portion 15 (see, e.g., FIGS. 4A and 4B).

Further, the virtual line illustrated in the enlarged view of the portion B in FIG. 3 is on the extension line of the upper surface of the attachment portion 20. As illustrated in a cross-sectional view taken along the line C-C in FIG. 3, the incidence portion 21 includes a curved surface 36 configured to be recessed on the lower surface of the lens body 14 and to be long in the front-to-rear direction, and is configured to efficiently distribute the incident light from the LED light source 17 to substantially the entire circumference of the first and the second reflecting surfaces 22 and 35. As illustrated in FIG. 2, the recessed portion 34 is formed so as to extend along a base edge (parabola) in a plan view of the lens 12.

Figure 4A:
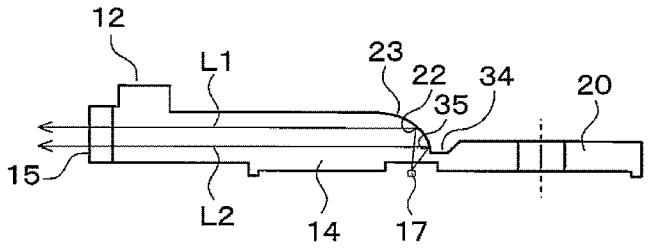
FIGS. 4A and 4B are cross-sectional views illustrating a reflecting action of lens in FIG. 3 in comparison with the related art.
Figure 4B:
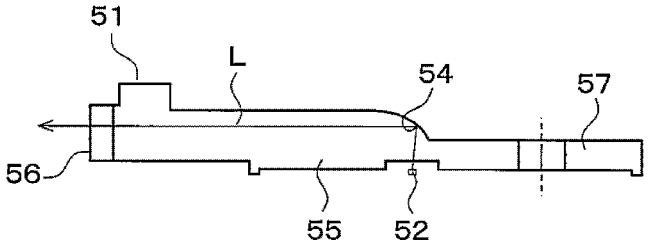
Figure 6A:
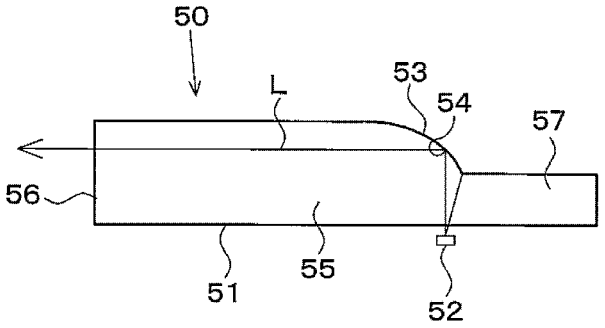
FIGS. 6A and 6B are cross-sectional views illustrating a lens according to the related art.
Figure 6B:
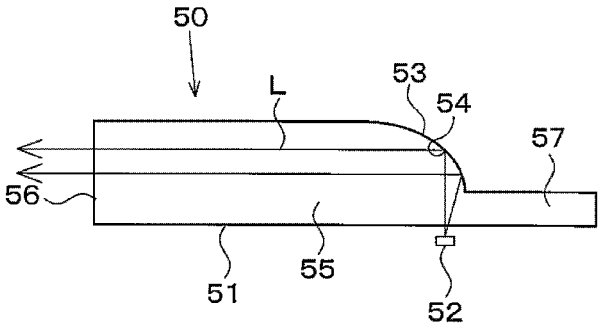

Therefore, according to the lens 12 of the exemplary embodiment, as illustrated in FIG. 4A, reflected light L2 from the second reflecting surface 35 is added to the reflected light L1 from the first reflecting surface 22, so that a larger amount of light may be emitted from the emitting portion 15 to the front of the edge light 11 in comparison with the lens 51 illustrated in FIG. 4B (the lens to which the technique of the related art illustrated in FIGS. 6A and 6B is applied). Further, since the second reflecting surface 35 is defined by the recessed portion 34 between the attachment portion 20 and the reflecting portion 23, the first reflecting surface 22 may be extended with the second reflecting surface 35 without reducing the thickness of the attachment portion 20, so that not only the light intensity of the edge light 11, but also the attachment strength of the lens 12 to the rear combination lamp 1 may be increased.

Figure 5:
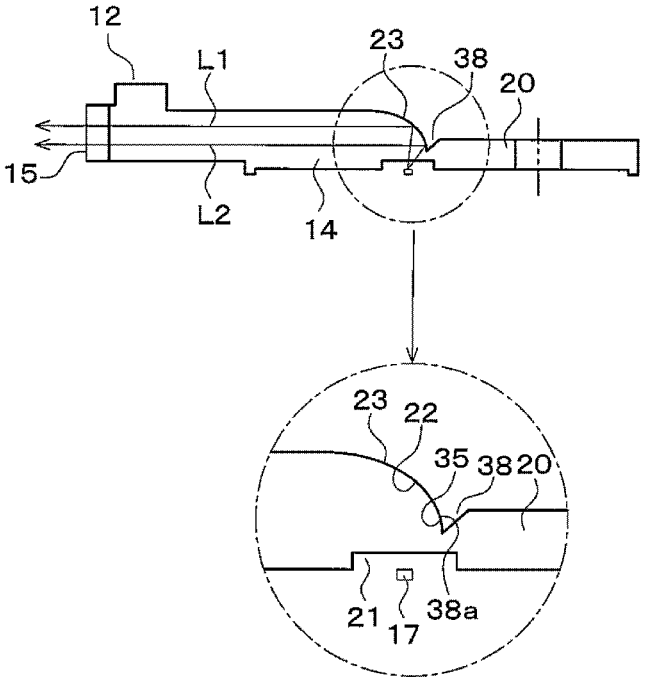
FIG. 5 is a cross-sectional view of a lens illustrating a variant of a recessed portion defining a reflecting surface.

FIG. 5 illustrates a modification of a recessed portion configured to form the second reflecting surface 35. In this lens 12, a groove 38 having a V-shaped cross section is formed on the upper surface of the lens body 14 so as to be recessed toward the incidence portion 21, and the second reflecting surface 35 is defined to continue to the lower side of the first reflecting surface 22 with the front side surface 38*a* of the groove 38. Therefore, with this modification, it is also possible to increase each of the light intensity of the edge light 11 and the attachment strength of the lens 12 as in the lens 12 illustrated in FIGS. 4A and 4B.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A lens comprising:

a lens body including:

an incidence portion on which light from a light source is incident;

a reflecting portion having a first reflecting surface configured to internally reflect the incident light toward a front side of the lens body;

an emitting portion configured to emit the reflected light; and an attachment portion configured to attach the lens body to a lamp and positioned at a rear side of the lens body opposite the front side of the lens body, wherein a recessed portion positioned on a top surface of the lens body and configured to define a second reflecting surface continuous to the first reflecting surface is formed between the attachment portion and the reflecting portion, the incidence portion is provided on a bottom surface of the lens body at a side opposite to the reflecting portion, and provided with a recessed surface that is recessed toward the first reflecting surface and the second reflecting surface, and configured to be elongated in a front side to rear side direction of the lens body, and the light source faces a direction orthogonal to the front side to rear side direction.

2. The lens of claim 1, wherein the emitting portion is positioned on the front side of the lens body opposite to the attachment portion, the reflecting portion is provided on the lens body, and the recessed portion is formed between the attachment portion and the reflecting portion to be recessed toward the incidence portion.

3. The lens of claim 1, wherein the recessed portion includes a flat bottom surface.

4. The lens of claim 2, wherein the recessed portion includes a flat bottom surface.

5. The lens of claim 1, wherein the recessed portion includes a groove having a substantially V-shaped cross section.

6. The lens of claim 2, wherein the recessed portion includes a groove having a substantially V-shaped cross section.

7. The lens of claim 1, wherein the first reflecting surface includes a parabolic surface opened toward the emitting portion, and the second reflecting surface includes a curved surface continuous to the parabolic surface.

8. The lens of claim 1, wherein the incidence portion includes a curved surface recessed in the lens body.

9. The lens of claim 1, wherein the recessed portion is formed so as to extend along a base edge of the reflecting portion when viewed from a top of the lens.

10. The lens of claim 1, wherein the recessed surface includes a curved surface, the curved surface being inwardly curved toward the light source.

11. The lens of claim 1, wherein the attachment portion further includes an attachment hole.

* * * * *